US005722012A

United States Patent [19]

Saitoh

[11] Patent Number: 5,722,012

[45] Date of Patent: Feb. 24, 1998

[54] IMAGE FORMING APPARATUS

[75] Inventor: Seiji Saitoh, Yokoham, Japan

[73] Assignee: Ricoh Company, Ltd., Tokyo, Japan

[21] Appl. No.: 705,308

[22] Filed: Aug. 29, 1996

[30] Foreign Application Priority Data

Sep. 9, 1995 [JP] Japan ..... 7-256762

[51] Int. Cl.[6] ..... G03G 21/00

[52] U.S. Cl. ..... 399/99; 399/98; 399/400

[58] Field of Search ..... 399/98, 99, 361, 399/381, 397, 400

[56] References Cited

U.S. PATENT DOCUMENTS

| | | | |
|---|---|---|---|
| 4,370,050 | 1/1983 | Matsui et al. | 399/99 |
| 4,827,311 | 5/1989 | Bothner et al. | 399/98 |
| 5,227,844 | 7/1993 | Bhattacharjee et al. | 399/99 |
| 5,394,224 | 2/1995 | Irobe | 399/99 |

FOREIGN PATENT DOCUMENTS

| | | |
|---|---|---|
| 5-257405 | 10/1993 | Japan . |
| 6-194900 | 7/1994 | Japan . |

*Primary Examiner*—Sandra L. Brase

*Attorney, Agent, or Firm*—Oblon, Spivak, McClelland, Maier & Neustadt, P.C.

[57] ABSTRACT

An electrophotographic image forming apparatus has an image forming device for forming a toner image, an image transfer device for transferring a toner image to a sheet, a toner fixing device for fixing the toner on the sheet and a conveying device for conveying the sheet from the image transfer device to the toner fixing device. A toner removing device is positioned in a conveyance path of the sheet from the image transfer device to the toner fixing device for removing toner from back of the sheet. The toner removing device assumes an electrical bias having a polarity opposite that of the toner.

9 Claims, 4 Drawing Sheets

IMAGE FORMING APPARATUS

BACKGROUND OF THE INVENTION

FIELD OF THE INVENTION

The present invention relates to an electrophotographic image forming apparatus applicable to, e.g., a copier, a facsimile apparatus or a printer.

DISCUSSION OF THE BACKGROUND

An image forming apparatus, in general, transfers a toner image on a drum to a surface of a sheet using an image transfer device and conveys the sheet to a fixing device, then fixes the toner image on the sheet.

It is important to prevent the back of the sheet becoming dirty. For example, toner that has remained on a drum due to sheet jamming, e.g., is transferred the image transfer roller, and the toner on the image transfer roller is transferred to the back of subsequent sheets. This not only makes the backs of the sheets dirty, but the toner on backs of the sheets may be transferred to a pressure roller on the fixing device, reducing its useful life and possibly making dirty the fronts of the fixed sheets.

An image forming apparatus including a felt device which contacts the fixing device and cleans it has been proposed in Japanese Patent Laid-Open Publication No. 5-257405 for overcoming the above problems. Another image forming apparatus, which stops recording if the paper jams, is proposed in Japanese Patent Laid-Open Publication No. 6-94900.

However, these devices cannot adequately remove the toner from back of the sheet. For example, the image forming apparatus in Japanese Patent Laid-Open Publication No. 5-257405 is able to remove the toner from the pressure roller, but cannot remove the toner from the back of a sheet. So the life of the pressure roller is reduced.

Further, while the image forming apparatus in Japanese Patent Laid-Open Publication No. 6-194900 can prevent the toner from attaching to the image transfer device if a sheet jams, it cannot prevent toner due to a dirty drum from attaching to the sheet.

So the problem that the pressure roller or the fixing roller or the back of the sheet becomes dirtied by toner has not been solved.

SUMMARY OF THE INVENTION

It is therefore an object of the present invention to provide an image forming apparatus capable of removing toner from back of a sheet while the sheet is being conveyed.

In accordance with a feature of the present invention, an image forming apparatus has a toner remover arranged between the image transfer device and the fixing device for removing toner from the back of a sheet being conveyed. The toner remover is arranged to face the sheet conveying path.

Also in accordance with the present invention, the toner remover receives an electrical charge having a polarity opposite that of the toner.

In one embodiment, the toner is magnetic and the remover includes a fixed magnet, a permanent magnet or an electromagnet.

Further, in accordance with the present invention the toner remover functions as a guide for guiding the sheet from the image transfer device to the fixing device, while being separated from the sheet by a fixed distance. This may be accomplished by use of a material that does not easily attract the toner.

Further, in accordance with the present invention, the toner remover is easily removably mounted in the main body of the apparatus.

BRIEF DESCRIPTION OF THE DRAWINGS

The above and the objects, features and advantage of the present invention will become more apparent from the following detailed description taken with the accompanying drawings in which.

DESCRIPTION OF THE PREFERRED EMBODIMENTS

Figure 1:
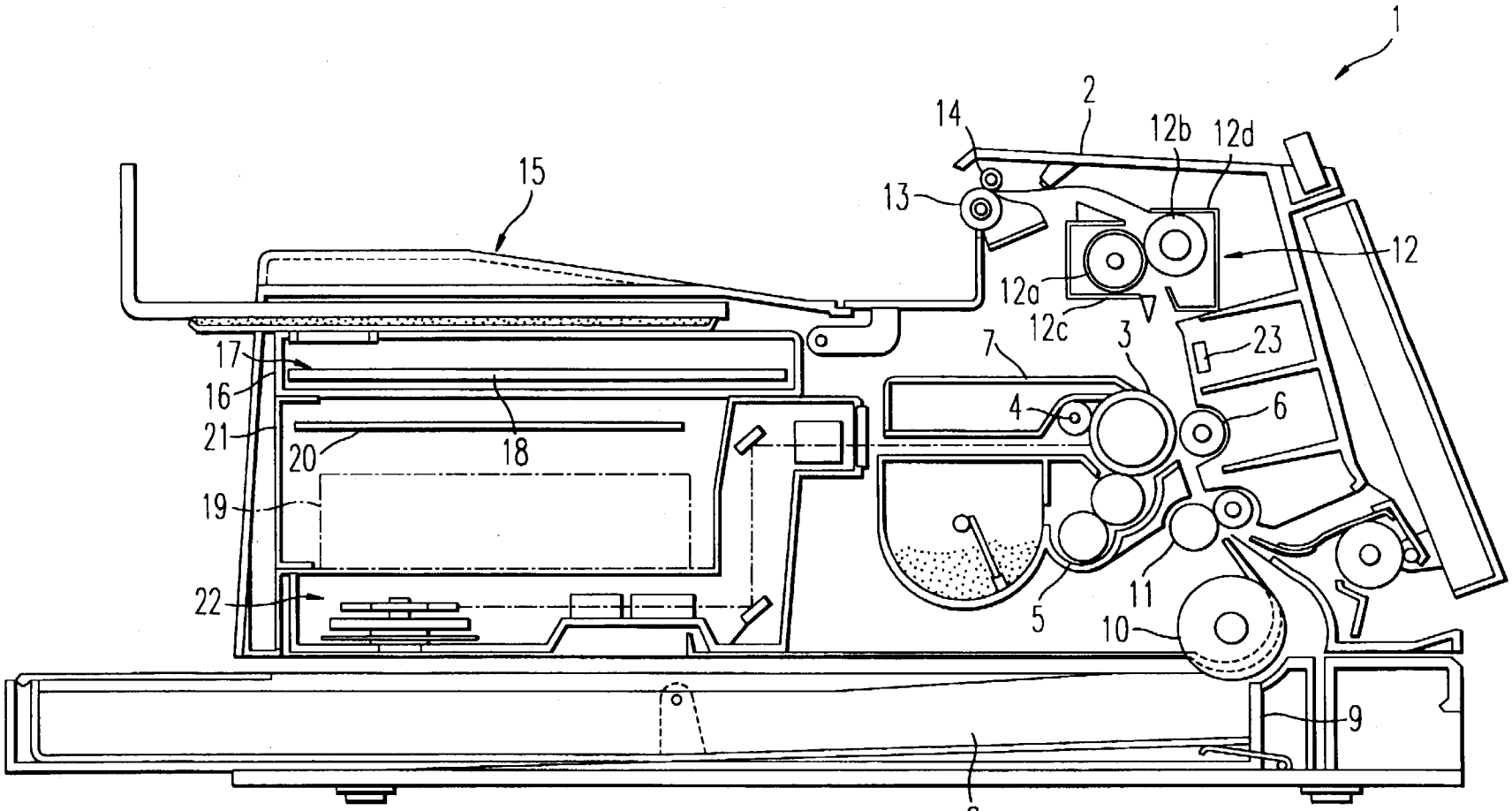
FIG. 1 is a section showing a first embodiment of the image forming apparatus in accordance with the present invention.

Referring to FIG. 1, the basic construction of an image forming apparatus 1 (e.g., a laser printer) in accordance with the present invention includes a drum 3 arranged near the center of the front side in a case 2. Inside the case 2 are arranged a charger 4, a developing unit 5, a image transfer roller 6 and a cleaner 7.

Under the drum 3 is a sheet cassette 9 which contains sheets 8, a feed roller 10 which separates and feeds sheets from the sheet cassette 9 and a timing roller 11 which conveys the sheets 8 to the image transfer roller 6 at a predetermined timing. Above the image transfer roller 6 there is a fixing unit 12 which heats the sheets 8 and fixes the toner image on the sheets. The fixing unit 12 conveys the sheets to the discharging rollers 13, 14, while fixing the toner image on the sheet. The discharging rollers 13, 14 discharge the sheets from the fixing unit 12 onto the tray 15 above the back side of the case 2.

An electrical unit 17 is positioned inside the metal case 16 under the sheet stacking tray and has a control board 18 on which are positioned regulation switches and a control unit (not shown). A case 21 containing a power supply unit 19 and an electrical board 20, and an optical unit 22 that forms an image carrier on the surface of the drum 3, are located under the case 16.

Figure 2:
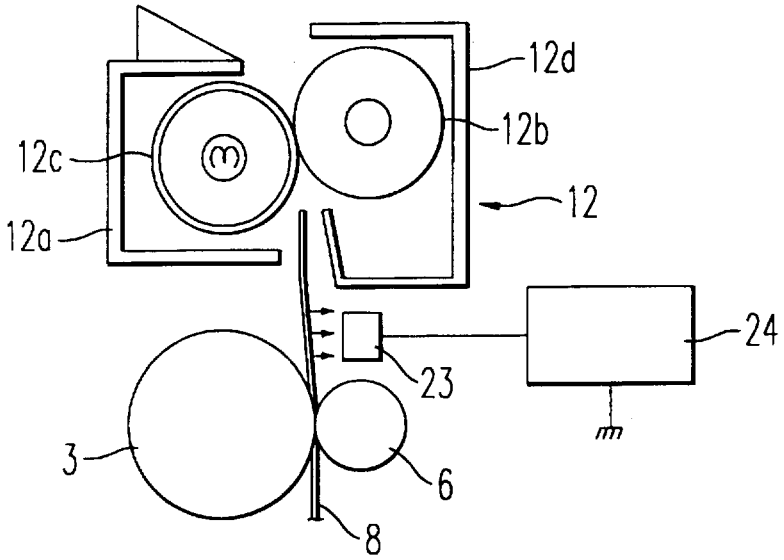
FIG. 2 is a schematic illustration showing the image transfer unit and the fixing unit of FIG. 1.

Referring to FIG. 2, the fixing unit 12 has a fixing roller **12*a* and a pressure roller 12*b*. The sheets are discharged vertically from image transfer roller 6, and then are sent between the fixing roller 12*a* and the pressure roller 12*b*. The fixing roller 12*a* and the pressure roller 12*b* are both covered with a cover 12*c*, 12*d*. As the fixing unit 12 conveys the sheets 8, the fixing roller 12*a* is pressed by the pressure roller 12*b* and heats the sheets 8** in order to fix the toner image on the sheets.

Between the fixing unit 12 and image transfer roller 6 is positioned a toner remover 23, including a metal board that guides the sheets 8 and receives an electrical charge of a fixed potential.

The toner removal unit 23 is readily removably mounted in the case 2. For example, it may be insertable and removable by hand from a recess in the inner surface of the case 2. Moreover, since it is positioned above the image transfer roller 6 and between the image transfer roller 6 and the fixing unit 12 it can be easily reached for installation and replacement. So it is easy to remove toner from the sheets 8 and to exchange the toner removal unit for a new one.

The toner removal unit 23 connects to a bias power supply unit 24 which is powered by, e.g, the power supply unit 19 and applies a bias voltage (electrical charge) having a polarity opposite that of the toner so that the toner attached to the backs of the sheets 8 is electrically attracted to the toner remover 23 and is removed from the sheets.

During operation, toner on the back of a sheet 8 being conveyed from the image transfer roller 6 to the fixing unit 12 is removed and collected by the toner removing unit 23. Namely, the laser printer 1 forms the latent image on the drum 3 charged uniformly by the charger 4 and then develops the toner image on the drum using the developing unit 5. Further, the laser printer 1 transfers the toner image to the surface of the sheet 8 fed from the feed cassette 9 and conveys it to the fixing unit 12, as shown with an arrow in FIG. 3.

After transferring the toner image to the sheet 8, residual toner is removed by a cleaning unit 7 and the drum is charged again by the charger 4.

The sheet 8 that is conveyed to the fixing unit 12 is pressed against the fixing roller 12*a* by the pressure roller 12*b* and is heated by the fixing roller 12*a* for fixing the toner image thereon. The sheet 8 is then conveyed to the discharging roller 13 by rotation of the fixing roller 12*a* and the pressure roller 12*b*. The discharging roller 13 discharges the sheet 8 to the stack tray 15 via the discharging roller 14.

As the sheet 8 passes through the image transfer unit 6, toner from the drum 3 sometimes attaches to the back of the sheet 8 due to a dirty drum 3, and the like. When this occurs, the toner attaches to the fixing roller 12*a* and the pressure roller 12*b*, which can impair fixing performance and dirty the backs of subsequent sheets 8.

However, in accordance with the invention, the toner removing unit 23, arranged in the conveying path of the sheet 8 between the image transfer unit 6 and the fixing unit 12, removes the toner from back of the sheet 8.

The toner removing unit 23 assumes a bias voltage (electrical charge) having a polarity opposite that of the toner. So the toner removing unit 23 is able to remove the toner from the back of the sheet 8 while the sheet 8 is being conveying. Consequently, it is able to prevent attachment of toner to the pressure roller 12*b* in the fixing unit 12, to prevent impairment of its performance and to prevent the backs of subsequent sheets from becoming dirty.

Further, as the toner remover is freely removably mounted in the apparatus, it is easy to remove the toner and to exchange the toner remover for a new one.

Figure 3:
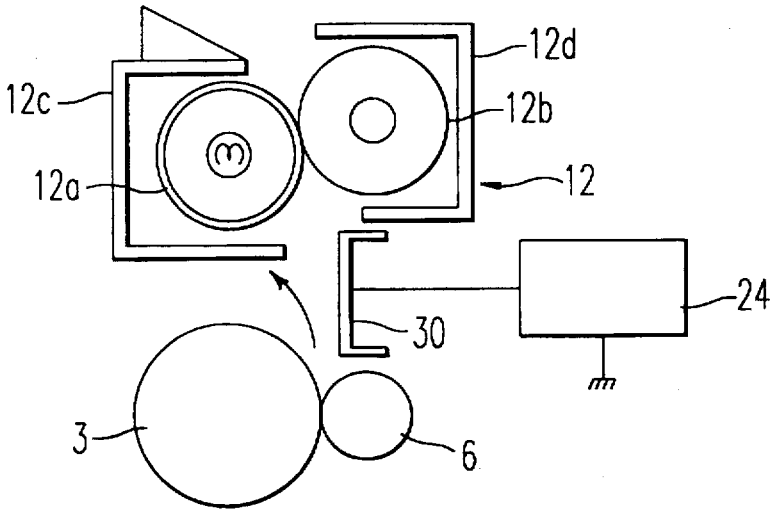
FIG. 3 is a schematic illustration showing a second embodiment of the image forming apparatus.
Figure 4:
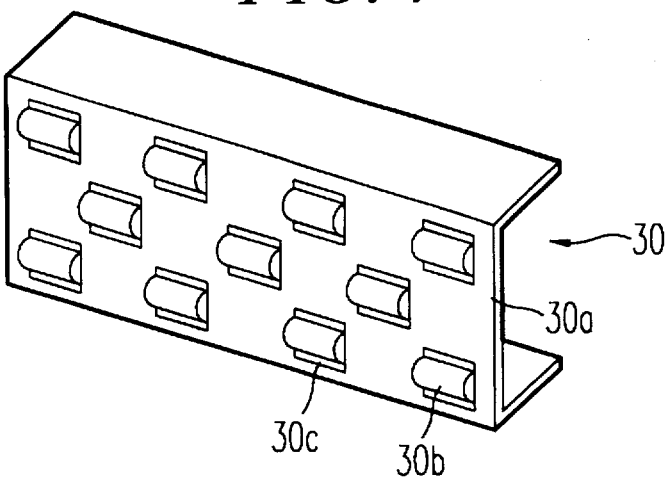
FIG. 4 is a schematic illustration showing the toner removing unit of FIG. 3.
Figure 5:
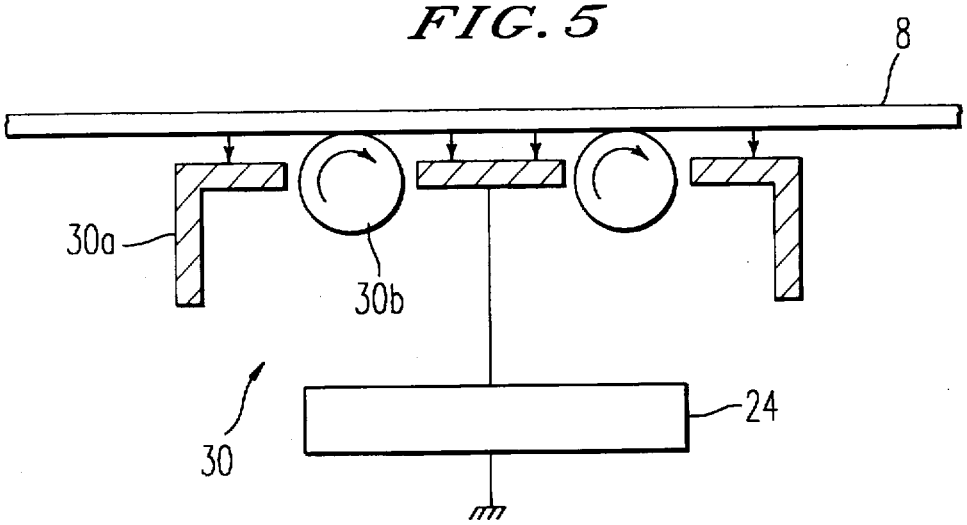
FIG. 5 is a schematic illustration showing operation of the toner removing unit in FIG. 3.

FIG. 3 through FIG. 5 illustrate a second embodiment of the invention. Explanation of features which are the same as in the first embodiment has been omitted.

Referring to FIG. 3, the toner removing unit 30 is arranged between the image transfer unit 6 and the fixing unit 12. As with the toner removing unit 23, it is easily accessible and removable.

Referring to FIG. 4, the toner removing unit 30 has a rectangular toner attracting board 30*a* composed of materials able to take an electrical charge of a fixed potential, e.g., metals, and conveying guide roll 30*b*.

The conveying guide rolls 30*b* are rotatably mounted on the attracting board 30*a* in parallel to the conveying direction of the sheets 8. Further, conveying guide bosses 30*c* are non-rotatably mounted on the attracting board 30*a* and extend therefrom by a fixed distance so that the conveyed sheets 8 do not contact the attracting board 30*a*.

The conveying guide rolls and bosses 30*b* –30*c* are composed of materials that do not take an electrical charge, e.g., resin, so that toner from the back of the conveyed sheets is not attached thereto.

The attracting board 30*a* is easily removably mounted to the case 2 by a support unit (not shown), like the toner removing unit 23, so it is easy to remove the toner and to exchange the toner removing unit 30.

Also, the attracting board 30*a* is connected with the bias power supply unit 24 that applies a predetermined bias voltage (electrical charge) having a polarity opposite that of the toner. Thus, the toner removing unit 30 guides the sheets 8 from the image transfer roller 6 to the fixing unit 12 without the sheets 8 contacting the attracting board 30*a* and the attracting board 30*a* removes the toner from the backs of the sheet 8 by the bias voltage.

In accordance with this embodiment, the sheets 8 having the transferred toner image are guided by the conveying guide rolls 30*b* to the fixing unit 12, and toner attached to the backs of the sheets is removed while keeping a fixed distance from the attracting board 30*a*. Thus the toner removing unit has two functions. One is to guide the conveyed sheets 8 from the image transfer roller 6 to the fixing unit 12 while another is to remove the toner from the back of the sheets 8 so that the roller of the fixing unit 12 are not damaged and the backs of subsequent sheets 8 are not made dirty by the toner. Additionally, the conventional guide unit may be omitted.

Because the toner removing unit 30 is positioned where the paper moves vertically from the image transfer roller to the fixing unit, the attracting force of the toner removing unit helps strip the paper from the image transfer roller and prevents the paper from curling away from the fixing unit 12.

A resinous conveying guide rib, e.g. polyacetal, may be used instead of the conveying guide rolls 30*b*.

Figure 6:
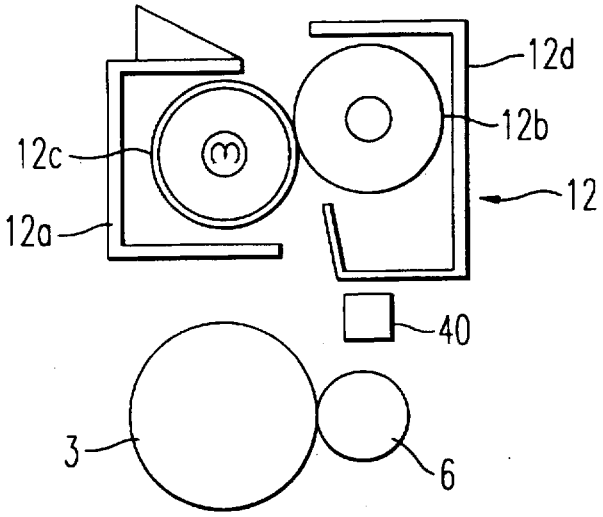
FIG. 6 is a schematic illustration showing a third embodiment of the image forming apparatus.

FIG. 6 illustrates a third embodiment of the invention. Explanation of features which are the same as in the earlier embodiments has been omitted.

This embodiment is used with magnetic toner. Thus, the toner removing unit 40 incorporates magnetic materials, e.g., a permanent magnet or an electromagnet, so that toner from backs of the sheets 8 is magnetically attracted to the toner removing unit 40 and removed.

Thus, the rollers of the fixing unit 12 are not damaged and the backs of subsequent sheets 8 are not made dirty by the toner. Additionally, the conventional guide unit may be omitted.

As in the previous embodiments, the toner removing unit 40 is easily removably installed and accessible in the case 2 and so exchange of the toner removing unit is easy.

While the above provides a full and complete disclosure of the preferred embodiments of the present invention, various modifications, alternate constructions and equivalents maybe employed without departing from the true spirit and the scope of the invention. For example, while the embodiments of the invention were described with reference to a laser printer, it is also adapted to a copier, facsimile apparatus or any other electrophotographic image forming apparatus.

What is claimed as new and desired to be secured by Letters Patent of the United States is:

1. An electrophotographic image forming apparatus comprising:

an image forming device for forming a toner image;

an image transfer device for transferring a toner image to a sheet;

a toner fixing device for fixing the toner on the sheet;

a conveying device for conveying the sheet from the image transfer device to the toner fixing device; and a toner removing device positioned in a conveyance path of the sheet from the image transfer device to the toner fixing device for removing toner from back of the sheet.

2. The electrophotographic image forming apparatus of claim 1 wherein said toner removing device assumes an electrical bias having a polarity opposite that of the toner.

3. The electrophotographic image forming apparatus of claim 1 wherein said toner removing device incorporates a magnet.

4. The electrophotographic image forming apparatus of claim 1 wherein said toner removing device comprises a sheet guide.

5. The electrophotographic image forming apparatus of claim 4 further comprising a conveying guide element which maintains the conveying sheet at a predetermined distance from said toner removing device.

6. The electrophotographic image forming apparatus of claim 1 wherein said toner removing device is removably mounted in a main body of the apparatus.

7. The electrophotographic image forming apparatus of claim 2 wherein said toner removing device is removably mounted in a main body of the apparatus.

8. The electrophotographic image forming apparatus of claim 3 wherein said toner removing device is removably mounted in a main body of the apparatus.

9. The electrophotographic image forming apparatus of claim 4 wherein said toner removing device is removably mounted in a main body of the apparatus.

* * * * *